US011798365B2

(12) United States Patent
Olive et al.

(10) Patent No.: US 11,798,365 B2
(45) **Date of Patent: *Oct. 24, 2023**

(54) GAMING MACHINE AND METHOD WITH PRIZE CHANCE CONFIGURABLE SYMBOL

(71) Applicant: Aristocrat Technologies Australia Pty Limited, North Ryde (AU)

(72) Inventors: Scott Olive, Brookvale (AU); Matthew Deitz, Dee Why (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 18/106,588

(22) Filed: Feb. 7, 2023

(65) Prior Publication Data

US 2023/0186727 A1 Jun. 15, 2023

Related U.S. Application Data

(63) Continuation of application No. 16/537,223, filed on Aug. 9, 2019, now Pat. No. 11,594,103.

(30) Foreign Application Priority Data

Oct. 3, 2018 (AU) ..... 2018241080
Nov. 22, 2018 (AU) ..... 2018101800

(51) Int. Cl.
*G07F 17/32* (2006.01)

(52) U.S. Cl.
CPC ..... *G07F 17/3258* (2013.01); *G07F 17/3211* (2013.01)

(58) Field of Classification Search
CPC ..... G07F 17/3258; G07F 17/3211
See application file for complete search history.

(56) References Cited

U.S. PATENT DOCUMENTS 6,251,013 B1 6/2001 Bennett
7,070,501 B2 7/2006 Cormack
(Continued)

FOREIGN PATENT DOCUMENTS

AU 2013202658 1/2014
AU 2013251288 A1 5/2014
(Continued)

OTHER PUBLICATIONS

Australian Examination Report for Application No. 2018278882, dated Dec. 9, 2019, 2 pages.
(Continued)

*Primary Examiner* — Thomas H Henry
(74) *Attorney, Agent, or Firm* — McAndrews, Held & Malloy, Ltd.

(57) ABSTRACT

A gaming machine initiates a feature game in response to a base game outcome comprising a predetermined number of a configurable symbol. For an initial round of a quantity of rounds for the feature game, the gaming machine retains each of the configurable symbol from the base game outcome at a corresponding feature game display position of a feature game outcome. For each feature game display position not displaying the configurable symbol, the gaming machine determines whether to display the configurable symbol with an assigned prize indicia at the respective feature game display position. After the quantity of rounds, the gaming machine awards a prize chance for a specific prize in response to a prize indicia for the specific prize being assigned to the feature game outcome. The gaming machine further awards the specific prize in response to randomly determining that the prize chance was successful.

20 Claims, 13 Drawing Sheets

(56) References Cited

U.S. PATENT DOCUMENTS

| | | | |
|---|---|---|---|
| 7,077,745 | B2 | 7/2006 | Gomez |
| 7,252,589 | B1 | 8/2007 | Marks |
| 7,419,162 | B2 | 9/2008 | Lancaster |
| 7,419,430 | B1 | 9/2008 | Joshi |
| 7,473,173 | B2 | 1/2009 | Peterson |
| 7,510,473 | B2 | 3/2009 | Thomas |
| 7,578,739 | B2 | 8/2009 | Gauselmann |
| 7,578,740 | B2 | 8/2009 | Marks |
| 7,591,724 | B2 | 9/2009 | Baerlocher |
| 7,601,060 | B2 | 10/2009 | Baerlocher |
| 7,601,061 | B2 | 10/2009 | Jackson |
| 7,614,948 | B2 | 11/2009 | Saffari |
| 7,618,315 | B2 | 11/2009 | Thomas |
| 7,625,278 | B2 | 12/2009 | Paulsen |
| 7,662,040 | B2 | 2/2010 | Englman |
| 7,666,093 | B2 | 2/2010 | Lafky |
| 7,666,094 | B2 | 2/2010 | Baerlocher |
| 7,674,178 | B2 | 3/2010 | Baerlocher |
| 7,674,179 | B2 | 3/2010 | Baerlocher |
| 7,695,359 | B2 | 4/2010 | Gail |
| 7,722,457 | B1 | 5/2010 | Marks |
| 7,731,581 | B2 | 6/2010 | Chamberlain |
| 7,749,064 | B2 | 7/2010 | Marks |
| 7,749,069 | B2 | 7/2010 | Randall |
| 7,775,873 | B2 | 8/2010 | Aoki |
| 7,780,531 | B2 | 8/2010 | Englman |
| 7,789,750 | B2 | 9/2010 | Marks |
| 7,789,755 | B2 | 9/2010 | Davis |
| D624,927 | S | 10/2010 | Allen |
| 7,833,094 | B2 | 11/2010 | Englman |
| 7,837,555 | B2 | 11/2010 | Cowan |
| 7,850,520 | B2 | 12/2010 | Yoshimi |
| 7,850,524 | B2 | 12/2010 | Jackson |
| 7,867,077 | B2 | 1/2011 | Baerlocher |
| 7,874,915 | B2 | 1/2011 | Caspers |
| 7,874,920 | B2 | 1/2011 | Hornik |
| 7,878,903 | B2 | 2/2011 | Chan |
| 7,901,282 | B2 | 3/2011 | Cannon |
| 7,914,377 | B2 | 3/2011 | Benbrahim |
| 7,927,209 | B2 | 4/2011 | Gagner |
| 7,946,915 | B2 | 5/2011 | Cannon |
| 7,951,004 | B2 | 5/2011 | Saffari |
| 7,955,170 | B2 | 6/2011 | Gail |
| 7,959,507 | B2 | 6/2011 | Cannon |
| 7,959,509 | B2 | 6/2011 | Saffari |
| 7,963,846 | B2 | 6/2011 | Englman |
| 7,963,847 | B2 | 6/2011 | Baerlocher |
| 7,976,379 | B2 | 7/2011 | Baerlocher |
| 7,980,938 | B2 | 7/2011 | Thomas |
| 7,985,133 | B2 | 7/2011 | Baerlocher |
| 8,012,014 | B2 | 9/2011 | Low |
| 8,021,222 | B2 | 9/2011 | Walker |
| 8,021,227 | B2 | 9/2011 | Baerlocher |
| 8,021,230 | B2 | 9/2011 | Baerlocher |
| 8,033,903 | B2 | 10/2011 | Cregan |
| 8,038,528 | B2 | 10/2011 | Englman |
| D648,347 | S | 11/2011 | Chaudhri |
| 8,057,292 | B2 | 11/2011 | Gail |
| 8,070,587 | B2 | 12/2011 | Davis |
| 8,083,578 | B2 | 12/2011 | Jackson |
| 8,087,995 | B2 | 1/2012 | Englman |
| 8,105,149 | B2 | 1/2012 | Dewaal |
| 8,113,939 | B2 | 2/2012 | Cannon |
| 8,113,947 | B2 | 2/2012 | Hornik |
| 8,118,669 | B2 | 2/2012 | Rader |
| 8,123,606 | B2 | 2/2012 | Hollibaugh |
| 8,133,120 | B2 | 3/2012 | Englman et al. |
| 8,137,174 | B2 | 3/2012 | Nicely et al. |
| 8,137,180 | B2 | 3/2012 | Thomas |
| 8,147,320 | B2 | 4/2012 | Englman |
| 8,182,338 | B2 | 5/2012 | Thomas |
| 8,187,089 | B2 | 5/2012 | Englman |
| 8,202,160 | B2 | 6/2012 | Englman |
| 8,216,051 | B2 | 7/2012 | Rasmussen |
| 8,216,065 | B2 | 7/2012 | Kaminkow |
| 8,235,804 | B2 | 8/2012 | Gagner |
| 8,251,791 | B2 | 8/2012 | Baerlocher |
| 8,262,458 | B2 | 9/2012 | Rodgers |
| 8,267,777 | B2 | 9/2012 | Jaffe |
| 8,287,367 | B2 | 10/2012 | Hall |
| 8,303,402 | B2 | 11/2012 | Aoki |
| 8,317,585 | B2 | 11/2012 | Gomez |
| 8,317,587 | B2 | 11/2012 | Gomez |
| 8,328,626 | B2 | 12/2012 | Hornik |
| 8,328,631 | B2 | 12/2012 | Baerlocher |
| 8,342,956 | B2 | 1/2013 | Anderson |
| 8,353,751 | B2 | 1/2013 | Bickley |
| 8,353,753 | B2 | 1/2013 | Thomas |
| 8,353,762 | B2 | 1/2013 | Rodgers |
| 8,360,851 | B2 | 1/2013 | Aoki |
| 8,460,083 | B2 | 6/2013 | Joshi |
| 8,460,087 | B2 | 6/2013 | Michel |
| 8,475,268 | B2 | 7/2013 | O'Halloran |
| 8,491,381 | B2 | 7/2013 | Nicely |
| 8,500,548 | B2 | 8/2013 | Baerlocher |
| 8,506,384 | B2 | 8/2013 | Coleman |
| 8,506,390 | B2 | 8/2013 | Vann |
| 8,506,391 | B2 | 8/2013 | Jaffe |
| 8,517,818 | B2 | 8/2013 | Nicely |
| 8,545,304 | B2 | 10/2013 | Aoki |
| 8,545,312 | B2 | 10/2013 | Brosnan |
| 8,545,313 | B2 | 10/2013 | Nicely |
| 8,545,321 | B2 | 10/2013 | Baerlocher |
| 8,562,418 | B2 | 10/2013 | Gomez |
| 8,591,311 | B2 | 11/2013 | Englman |
| 8,591,313 | B2 | 11/2013 | Gomez |
| 8,591,324 | B2 | 11/2013 | Fitzsimons |
| 8,616,981 | B1 | 12/2013 | Guinn |
| 8,628,400 | B2 | 1/2014 | Aoki |
| 8,641,520 | B2 | 2/2014 | Vann |
| 8,684,816 | B2 | 4/2014 | Ajiro |
| 8,747,205 | B2 | 6/2014 | Englman |
| 8,753,188 | B2 | 6/2014 | Cannon |
| 8,784,191 | B1 | 7/2014 | Basallo |
| 8,790,177 | B2 | 7/2014 | Nicely |
| 8,814,652 | B2 | 8/2014 | Harkins |
| 8,858,318 | B2 | 10/2014 | Caputo |
| 8,979,635 | B2 | 3/2015 | Vann |
| 8,979,657 | B2 | 3/2015 | Englman |
| 8,986,107 | B2 | 3/2015 | Nicely |
| 9,058,714 | B2 | 6/2015 | Hamlin |
| 9,064,375 | B2 | 6/2015 | Johnson |
| 9,098,968 | B1 | 8/2015 | Nelson |
| 9,142,083 | B2 | 9/2015 | Granger |
| 9,171,423 | B2 | 10/2015 | O'Halloran |
| 9,235,965 | B2 | 1/2016 | Tuck |
| 9,275,510 | B2 | 3/2016 | Anderson |
| 9,305,433 | B2 | 4/2016 | Vann |
| 9,330,530 | B2 | 5/2016 | Englman |
| 9,378,608 | B2 | 6/2016 | Enzminger |
| 9,390,585 | B2 | 7/2016 | Nelson |
| 9,424,720 | B2 | 8/2016 | Suda |
| 9,466,180 | B2 | 10/2016 | Englman |
| 9,489,804 | B2 | 11/2016 | Ward |
| 9,508,224 | B2 | 11/2016 | Russell |
| 9,514,605 | B2 | 12/2016 | Nicely |
| 9,533,216 | B2 | 1/2017 | Caputo |
| 9,558,629 | B2 | 1/2017 | Schaefer |
| 9,564,007 | B2 | 2/2017 | Dicillo |
| D783,644 | S | 4/2017 | Lokrantz |
| 9,646,458 | B2 | 5/2017 | Zielinski |
| 9,685,039 | B2 | 6/2017 | Evans |
| 9,767,650 | B2 | 9/2017 | Jaffe |
| 9,842,469 | B2 | 12/2017 | Amaitis |
| 9,916,735 | B2 | 3/2018 | Chun |
| 9,928,691 | B2 | 3/2018 | Olive |
| 9,990,804 | B2 | 6/2018 | Aoki |
| D824,932 | S | 8/2018 | Joensson |
| D832,295 | S | 10/2018 | Chung |
| D832,883 | S | 11/2018 | Crosley |
| D834,596 | S | 11/2018 | Bae |
| 10,169,957 | B2 | 1/2019 | Hightower |
| D847,825 | S | 5/2019 | Coren |
| D847,848 | S | 5/2019 | Suslik |

(56) References Cited

U.S. PATENT DOCUMENTS

| | | | |
|---|---|---|---|
| 10,325,450 | B2 | 6/2019 | Hallerbach |
| 10,388,108 | B2 | 8/2019 | Cuddy |
| 10,720,022 | B2 | 7/2020 | Caputo |
| D916,751 | S | 4/2021 | La Guardia |
| D921,013 | S | 6/2021 | Boese |
| D924,248 | S | 7/2021 | Boese |
| D931,317 | S | 9/2021 | Omoigui |
| 2003/0060272 | A1 | 3/2003 | Glavich |
| 2003/0130027 | A1 | 7/2003 | Aida |
| 2003/0216165 | A1 | 11/2003 | Singer |
| 2004/0048646 | A1 | 3/2004 | Visocnik |
| 2004/0053680 | A1 | 3/2004 | Schultz |
| 2004/0137982 | A1 | 7/2004 | Cuddy |
| 2004/0266508 | A1 | 12/2004 | D Avanzo |
| 2005/0043082 | A1 | 2/2005 | Peterson |
| 2006/0084498 | A1 | 4/2006 | Baerlocher |
| 2006/0189369 | A1 | 8/2006 | Taylor |
| 2007/0060248 | A1 | 3/2007 | Rodgers |
| 2007/0129135 | A1 | 6/2007 | Marks |
| 2007/0178965 | A1 | 8/2007 | Inoue |
| 2008/0032773 | A1 | 2/2008 | Okada |
| 2008/0039191 | A1 | 2/2008 | Cuddy |
| 2008/0182650 | A1 | 7/2008 | Randall |
| 2009/0054129 | A1 | 2/2009 | Yoshimura |
| 2009/0124326 | A1 | 5/2009 | Caputo |
| 2009/0131145 | A1 | 5/2009 | Aoki |
| 2009/0239631 | A1 | 9/2009 | Aoki |
| 2009/0239634 | A1 | 9/2009 | Nguyen |
| 2009/0305766 | A1 | 12/2009 | Ashley |
| 2010/0022294 | A1 | 1/2010 | Yoshizawa |
| 2010/0029364 | A1 | 2/2010 | Zielinski |
| 2010/0075737 | A1 | 3/2010 | Bluemel |
| 2010/0093422 | A1 | 4/2010 | Gomez |
| 2010/0130281 | A1 | 5/2010 | Little |
| 2010/0210343 | A1 | 8/2010 | Englman |
| 2010/0234092 | A1 | 9/2010 | Gomez |
| 2010/0281107 | A1 | 11/2010 | Fallows |
| 2011/0157196 | A1 | 6/2011 | Nave |
| 2011/0165934 | A1 | 7/2011 | Marks |
| 2012/0015707 | A1 | 1/2012 | Hornik |
| 2012/0094738 | A1 | 4/2012 | Aoki |
| 2012/0178517 | A1 | 7/2012 | Montenegro |
| 2013/0217469 | A1 | 8/2013 | Fujisawa |
| 2013/0225258 | A1 | 8/2013 | Caputo |
| 2013/0303265 | A1 | 11/2013 | Wilkins |
| 2013/0331168 | A1 | 12/2013 | Street |
| 2014/0080564 | A1 | 3/2014 | Acres |
| 2014/0080570 | A1 | 3/2014 | Watkins |
| 2014/0274280 | A1 | 9/2014 | Macbeth |
| 2014/0274292 | A1 | 9/2014 | Suda |
| 2014/0309013 | A1 | 10/2014 | Meyer |
| 2014/0323198 | A1 | 10/2014 | Tuck |
| 2015/0126279 | A1 | 5/2015 | Lyons |
| 2015/0310699 | A1 | 10/2015 | Meyer |
| 2015/0332544 | A1 | 11/2015 | Kitamura |
| 2016/0042597 | A1 | 2/2016 | Olive |
| 2016/0253873 | A1 | 9/2016 | Olive |
| 2016/0364944 | A1 | 12/2016 | Elias |
| 2017/0032609 | A1 | 2/2017 | Inamura |
| 2017/0061743 | A1 | 3/2017 | Itagaki |
| 2017/0148274 | A1 | 5/2017 | Olive |
| 2017/0154498 | A1 | 6/2017 | Olive |
| 2018/0001216 | A1 | 1/2018 | Bruzzo |
| 2018/0075708 | A1 | 3/2018 | San |
| 2018/0211478 | A1 | 7/2018 | Elias |
| 2018/0268655 | A1 | 9/2018 | Olive |
| 2019/0051097 | A1 | 2/2019 | Marks |
| 2019/0206191 | A1 | 7/2019 | Halvorson |
| 2020/0111312 | A1 | 4/2020 | Olive |
| 2021/0343119 | A1 | 11/2021 | Colvin |

FOREIGN PATENT DOCUMENTS

| | | | |
|---|---|---|---|
| AU | 2014202042 | A1 | 5/2014 |
| AU | 2017101097 | A4 | 9/2017 |
| EP | 0984408 | | 3/2000 |

OTHER PUBLICATIONS

Australian Examination Report for AU2016100230, dated May 11, 2016, 5 pages.
Australian Examination Report for AU2015210489, dated Jun. 14, 2016, 5 pages.
Australian Examination Report for AU2016202727, dated Jul. 4, 2016, 5 pages.
Australian Examination Report for AU2017101097, dated Dec. 7, 2017. (3 pages).
Australian Examination Report for AU2017101629, dated Jan. 16, 2018, 3 pages.
Australian Examination Report for AU2017204560, dated Feb. 1, 2018, 3 pages.
Australian Examination Report for Application No. 2018241080, dated Sep. 24, 2019.
U.S. Appl. No. 16/455,166, filed Jun. 27, 2019, System and Method for Providing a Feature Game.
Australian Examination Report for Application No. 2019200719, dated Apr. 8, 2020, 3 pages.
Office Action dated Jun. 4, 2020 for U.S. Appl. No. 29/622,662 (pp. 1-8).
Office Action dated Jun. 25, 2020 for U.S. Appl. No. 16/537,223 (pp. 1-11).
Notice of Allowance dated Aug. 31, 2020 for U.S. Appl. No. 29/622,662 (pp. 1-7).
Notice of Allowance dated Dec. 1, 2020 for U.S. Appl. No. 16/383,435 (pp. 1-7).
Office Action dated Sep. 2, 2020 for U.S. Appl. No. 16/383,435 (pp. 1-7).
Notice of Allowance dated Jan. 13, 2021 for U.S. Appl. No. 16/455,166 (pp. 1-9).
Office Action dated Jan. 7, 2021 for U.S. Appl. No. 16/679,694 (pp. 1-8).
Office Action dated Jan. 27, 2021 for U.S. Appl. No. 16/537,223 (pp. 1-13).
Notice of Allowance dated Jan. 7, 2022 for U.S. Appl. No. 29/759,689 (pp. 1-7).
Notice of Allowance dated Mar. 18, 2021 for US App. No. 16/455,166 (pp. 1-7).
Notice of Allowance dated Apr. 20, 2021 for U.S. Appl. No. 16/679,694 (pp. 1-8).
Office Action dated May 11, 2021 for U.S. Appl. No. 16/537,223 (pp. 1-21).
Office Action dated May 27, 2021 for U.S. Appl. No. 16/679,694 (pp. 1-7).
Office Action dated Jun. 8, 2021 for U.S. Appl. No. 16/674,308 (pp. 1-7).
Office Action dated Jun. 10, 2021 for US App. No. 16/455,166 (pp. 1-7).
Office Action dated Jun. 24, 2021 for U.S. Appl. No. 16/733,933 (pp. 1-8).
Office Action dated Jul. 9, 2021 for U.S. Appl. No. 16/703,573 (pp. 1-9).
Office Action dated Jul. 9, 2021 for U.S. Appl. No. 16/703,602 (pp. 1-10).
Office Action (Non-Final Rejection) dated Sep. 16, 2021 for U.S. Appl. No. 16/782,615 (pp. 1-6).
Office Action (Notice of Allowance and Fees Due (PTOL-85)) dated Sep. 15, 2021 for U.S. Appl. No. 16/679,694 (pp. 1-7).
Office Action (Notice of Allowance and Fees Due (PTOL-85)) dated Sep. 17, 2021 for U.S. Appl. No. 16/740,774 (pp. 1-8).
Office Action (Non-Final Rejection) dated Oct. 4, 2021 for U.S. Appl. No. 16/783,593 (pp. 1-9).
Office Action (Notice of Allowance and Fees Due (PTOL-85)) dated Oct. 14, 2021 for U.S. Appl. No. 16/733,933 (pp. 1-7).

(56) References Cited

OTHER PUBLICATIONS

Australian Examination Report No. 1 for App. No. AU2020239761, dated Oct. 11, 2021, 6 pages.
Office Action (Notice of Allowance and Fees Due (PTOL-85)) dated Nov. 3, 2021 for U.S. Appl. No. 16/703,573 (pp. 1-7).
Office Action (Notice of Allowance and Fees Due (PTOL-85)) dated Nov. 2, 2021 for U.S. Appl. No. 16/703,602 (pp. 1-7).
Office Action (Notice of Allowance and Fees Due (PTOL-85)) dated Nov. 4, 2021 for U.S. Appl. No. 16/455,166 (pp. 1-7).
Office Action (Notice of Allowance and Fees Due (PTOL-85)) dated Nov. 4, 2021 for U.S. Appl. No. 16/674,308 (pp. 1-7).
Office Action (Final Rejection) dated Jan. 3, 2022 for U.S. Appl. No. 16/537,223 (pp. 1-21).
Notice of Allowance dated Jan. 7, 2022 for U.S. Appl. No. 29/756,837 (pp. 1-8).
Notice of Allowance dated Jan. 7, 2022 for US App. No. 29/761, 787 (pp. 1-8).
Office Action (Notice of Allowance and Fees Due (PTOL-85)) dated Jan. 21, 2022 for U.S. Appl. No. 16/782,615 (pp. 1-7).
Office Action (Notice of Allowance and Fees Due (PTOL-85)) dated Jan. 27, 2022 for U.S. Appl. No. 16/783,593 (pp. 1-7).
Office Action (Notice of Allowance and Fees Due (PTOL-85)) dated Feb. 25, 2022 for U.S. Appl. No. 16/783,593 (pp. 1-1).
Office Action (Notice of Allowance and Fees Due (PTOL-85)) dated Mar. 15, 2022 for U.S. Appl. No. 16/782,615 (pp. 1-8).
Protest Under 37.C.F.R. 1.291 filed in U.S. Appl. No. 17/562,278 dated Mar. 14, 2022, 11 pages.
Office Action (Notice of Allowance and Fees Due (PTOL-85)) dated Apr. 16, 2022 for U.S. Appl. No. 16/782,615 (pp. 1-1).
Office Action (Non-Final Rejection) dated Jun. 15, 2022 for U.S. Appl. No. 16/537,223 (pp. 1-20).
Office Action (Notice of Allowance and Fees Due (PTOL-85)) dated Nov. 25, 2022 for U.S. Appl. No. 16/537,223 (pp. 1-8).
Office Action (Notice of Allowance and Fees Due (PTOL-85)) dated Dec. 28, 2022 for U.S. Appl. No. 16/537,223 (pp. 1-2).
Office Action (Notice of Allowance and Fees Due (PTOL-85)) dated Jun. 2, 2023 for U.S. Appl. No. 17/562,278 (pp. 1-7).
Office Action (Notice of Allowance and Fees Due (PTOL-85)) dated Jun. 17, 2023 for U.S. Appl. No. 17/562,278 (pp. 1-1).

300

| | Reel strip position | Reel 1 (321) | Reel 2 (322) | Reel 3 (323) | Reel 4 (324) | Reel 5 (325) |
|---|---|---|---|---|---|---|
| 301 | 1 | Pic 1 | 10 | Pic 3 | Config | Pic 1 |
| 302 | 2 | Wild | Config | K | A | 10 |
| 303 | 3 | Config | K | 10 | 10 | A |
| 304 | 4 | Q | Config | Q | Config | Pic 2 |
| 305 | 5 | 10 | Pic 2 | K | J | A |
| 306 | 6 | A | 9 | Pic 1 | Wild | Q |
| 307 | 7 | Pic 2 | Wild | Config | 9 | Config |
| 308 | 8 | Config | Pic 3 | Config | Config | Pic 2 |
| 309 | 9 | Config | Q | 9 | A | 9 |
| 310 | 10 | K | Config | Q | Q | Wild |
| 311 | 11 | J | Config | 10 | Config | 9 |
| 312 | 12 | 10 | Wild | Wild | K | Q |
| 313 | 13 | Pic 3 | K | A | Wild | Config |
| 314 | 14 | Wild | J | A | Pic 3 | Wild |
| 315 | 15 | 9 | 10 | Wild | Pic 1 | A |

343 342 341

FIG. 3

GAMING MACHINE AND METHOD WITH PRIZE CHANCE CONFIGURABLE SYMBOL

RELATED APPLICATIONS

The present application is a continuation of U.S. patent application Ser. No. 16/537,223, filed Aug. 9, 2019, which claims priority to Australian Patent Application No. 2018241080, filed Oct. 3, 2018, and claims priority to Australian Patent Application No. 2018101800, filed Nov. 22, 2018, all of which are incorporated herein by reference in their entirety.

FIELD

The present application relates to a gaming device.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

An example embodiment provides a gaming device comprising a display, a processor, and a memory storing a plurality of reel strips comprising configurable symbols and non-configurable symbols, prize data defining a plurality of prizes that can be assigned to configurable symbols including at least one prize chance associated with a specific prize, and instructions. When the instructions are executed by the processor, they cause the processor to assign a respective prize of the plurality of prizes to at least each configurable symbol selected for display, select a plurality of symbols from the reel strips, control the display to display the selected symbols in a plurality of columns of display positions during play of a base game, and upon the displayed symbols at the conclusion of symbol selection including a configurable symbol to which a prize chance has been assigned, conduct a random determination to determine whether to award the specific prize.

In an embodiment, the specific prize is a state-wide jackpot prize awardable at respective ones of a plurality of venues.

In an embodiment, when the instructions are executed by the processor, they cause the processor to, upon determining not to award the specific prize, award a consolation prize.

In an embodiment, the instructions are executed by the processor, they cause the processor to conduct a base game and, upon a trigger condition being met, conduct a feature game comprising free games, and wherein symbol selection concludes at the end of the free games.

In an embodiment, when the instructions are executed by the processor, they cause the processor to make an award of credits based on a total of prize values assigned to collected configurable symbols at the end of the free games.

Another example embodiment provides a method of operating a gaming device comprising a display and a memory storing a plurality of reel strips comprising configurable symbols and non-configurable symbols, and prize data defining a plurality of prizes that can be assigned to configurable symbols including at least one prize chance associated with a specific prize. The method comprises assigning a respective prize of the plurality of prizes to at least each configurable symbol selected for display, selecting a plurality of symbols from the reel strips, controlling the display to display the selected symbols in a plurality of columns of display positions during play of a base game, and upon the displayed symbols at the conclusion of symbol selection including a configurable symbol to which a prize chance has been assigned, conducting a random determination to determine whether to award the specific prize.

Another example embodiment provides a gaming system comprising a display, one or more processors, and a memory storing a plurality of reel strips comprising configurable symbols and non-configurable symbols, prize data defining a plurality of prizes that can be assigned to configurable symbols including at least one prize chance associated with a specific prize, and instructions. When the instructions are executed by the one or more processors, they cause the one or more processors to assign a respective prize of the plurality of prizes to at least each configurable symbol selected for display, select a plurality of symbols from the reel strips, control the display to display the selected symbols in a plurality of columns of display positions during play of a base game, and upon the displayed symbols at the conclusion of symbol selection including a configurable symbol to which a prize chance has been assigned, conduct a random determination to determine whether to award the specific prize.

BRIEF DESCRIPTION OF THE DRAWINGS

FIG. 3 illustrates an example reel strip layout.

DETAILED DESCRIPTION

Figure 1:
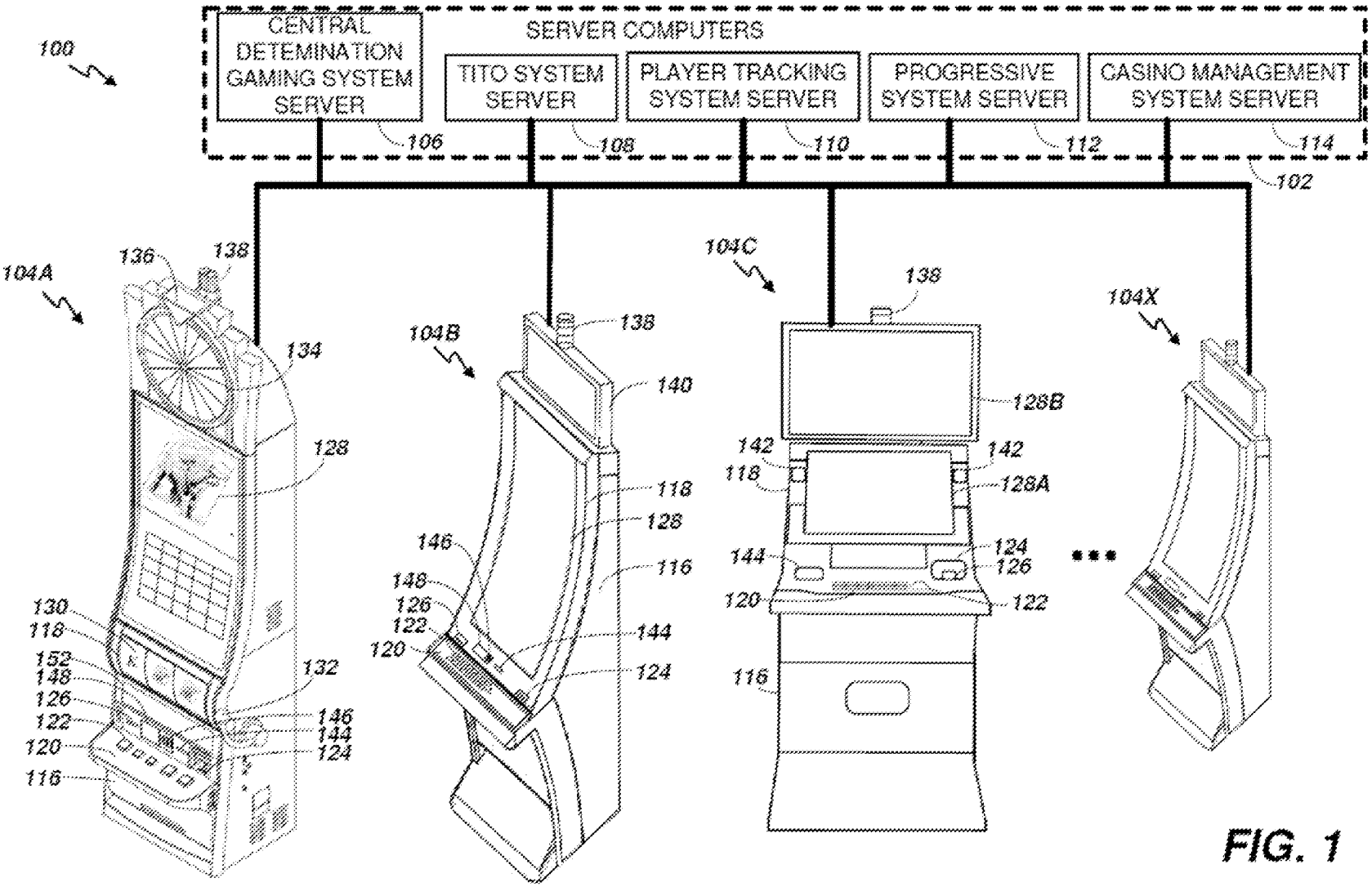
FIG. 1 is an exemplary diagram showing several EGMs networked with various gaming related servers.

FIG. 1 illustrates several different models of EGMs which may be ed to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
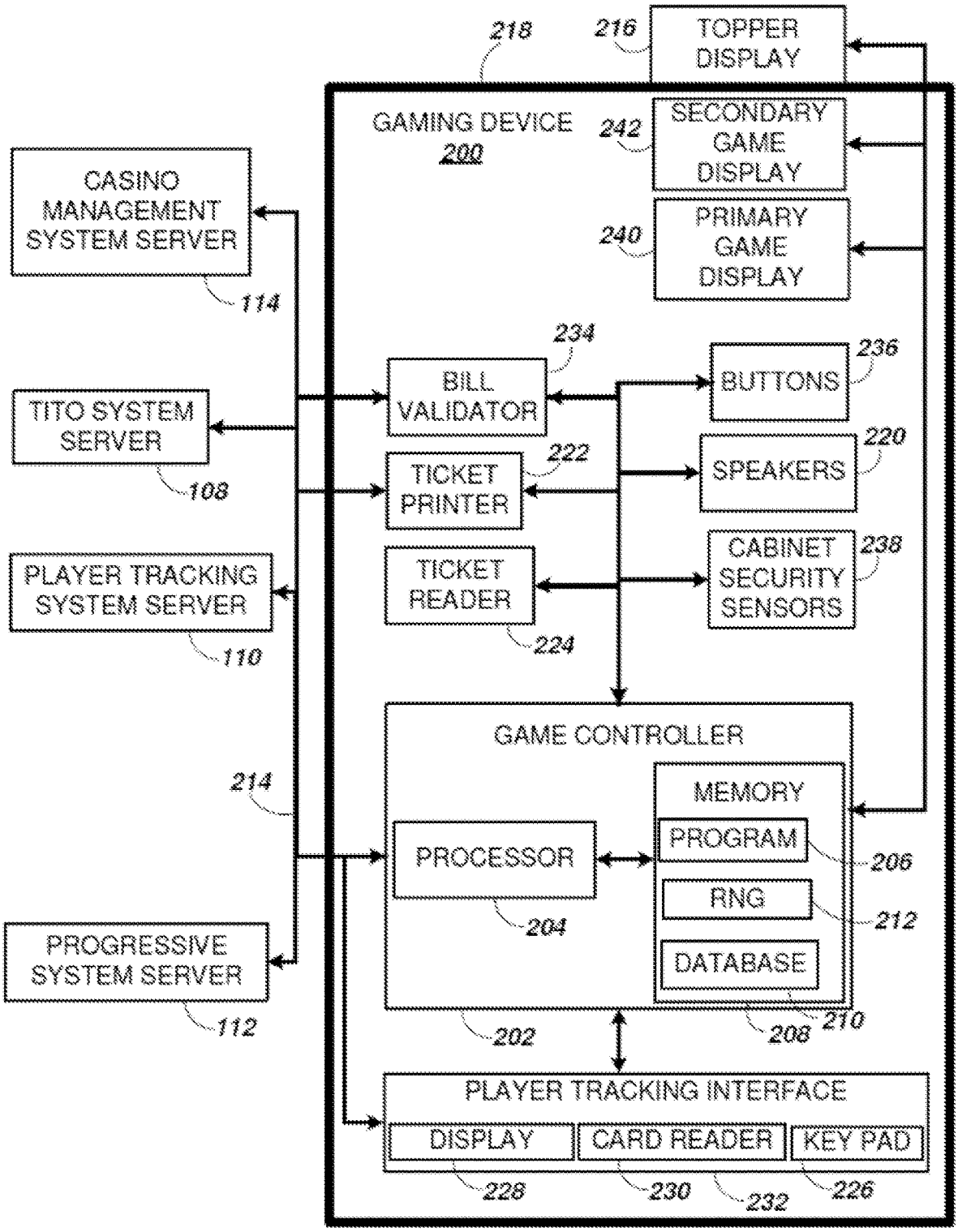
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 1048.

Example gaming device 1048 includes a main cabinet 116 including a main door 118 which opens to provide access to the interior of the gaming device 1048. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 1288 is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 5:
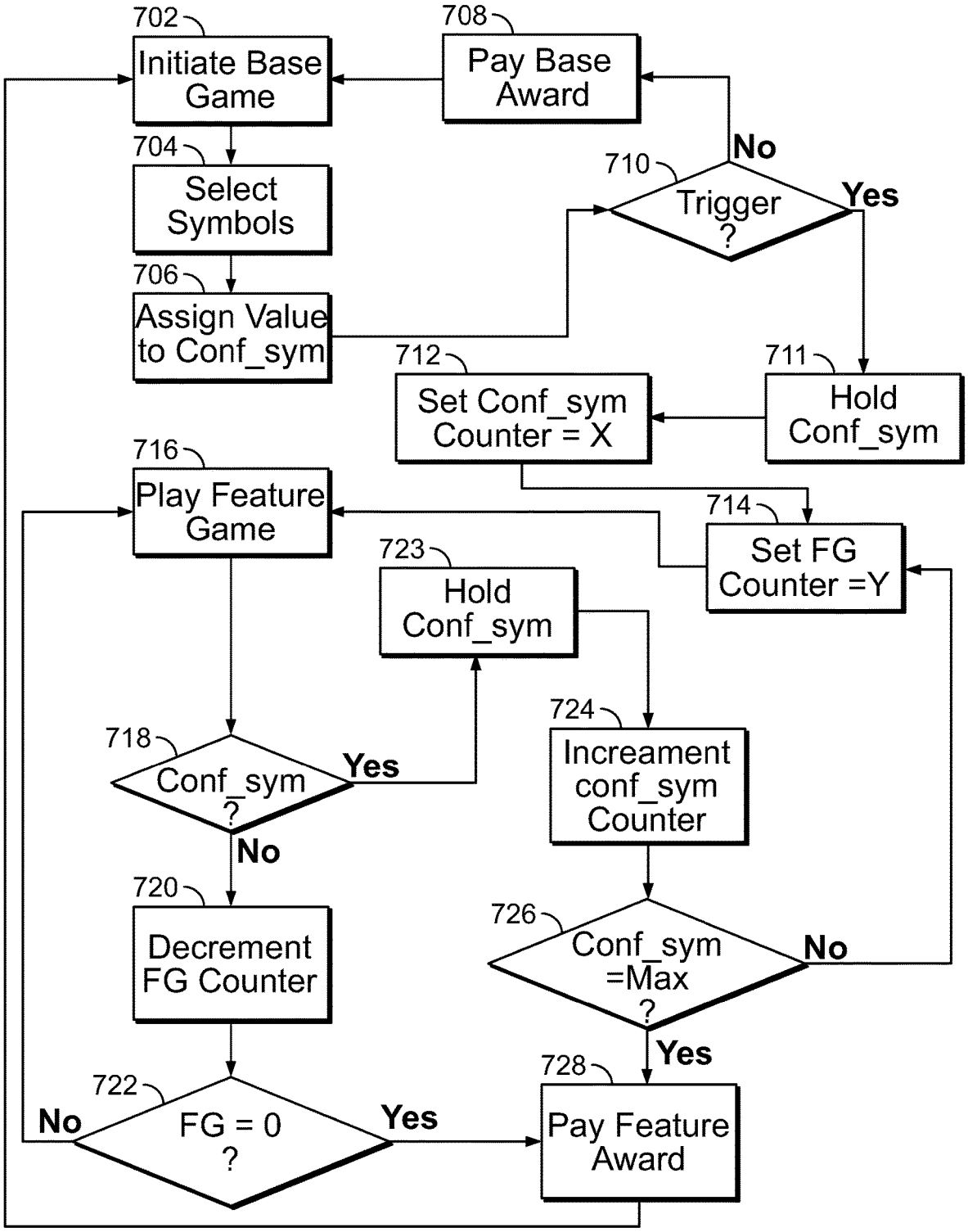
FIG. 5 is a flow chart of an embodiment of operating a gaming device.

FIG. 5 shows a flow diagram of one embodiment of a method of operating a gaming device 200. In the embodiment, when the processor 204 executes program code in memory 208, the processor 204 carries out the method. After the processor 204 receives a player input, at step 702 the processor 204 initiates a base game. In this embodiment, the base game is a spinning reel-game where the processor selects a plurality of symbols from a first set of reel strips to display in a plurality of columns of symbols. Each reel of the first set of reel strips or "reels" comprises a plurality of configurable symbols and non-configurable symbols. The player can win an award derived from values assigned to selected configurable symbols. The player can also win a prize, for example, a linked "Grand Jackpot" prize, if a defined number of configurable symbols are collected during a feature game. In embodiments of the invention the configurable symbols can be assigned a prize in the form of a chance to win a prize. Such prize chances are particularly suited to awarding large prizes such as a multi-venue jackpot prize, for example, a "State-Wide" jackpot. As explained in further detail below, once the player is awarded such a prize chance, the gaming device conducts a further random determination to determine whether to award the prize. While particularly suited to large prizes, awarding a prize chance can be used for other prizes (for example, a specific promotion offered by a venue) as a way to increase player engagement and/or interaction with the gaming device.

In an embodiment, the configurable symbols each comprise at least a common component and at least a variable component. The variable component is indicative of a value of a prize that is associated with each of the configurable symbols. Configurable symbols 751-756 are shown, for example, in FIG. 7. The common component is that the symbols 751-756 are in the form of a gold coin, while the variable component is the indicia on the coin. For example the indicia "3000" on configurable symbol 752 is numerals directly indicative of the value of the prize, here 3000 credit. The indicia can also indirectly indicate the value of the prize, for example "mini bonus" indicia on configurable symbols 751, 754, 755 and 756 indicates that the prize is the value currently shown for the mini bonus 808, here $10. Embodiments include other indirectly indicative indicia, such as "major" indicia, or "minor" indicia. It will be appreciated that the indicia can also be in other forms, which may also be indicative of a prize. For example, a car icon indicates that the player has won a car. In some embodiments, the indicia may indicate only a portion of a prize. Continuing with the car example, the car icon may be split into four portions, each portion being assigned to a different configurable symbol. In such embodiments, all four portions of the car icon are required to be selected for display in order for the car prize to be won. Other indicia may indicate a prize chance, for example below the indicia "State-Wide Chance" indicates a chance to win a state-wide jackpot.

Figure 9:
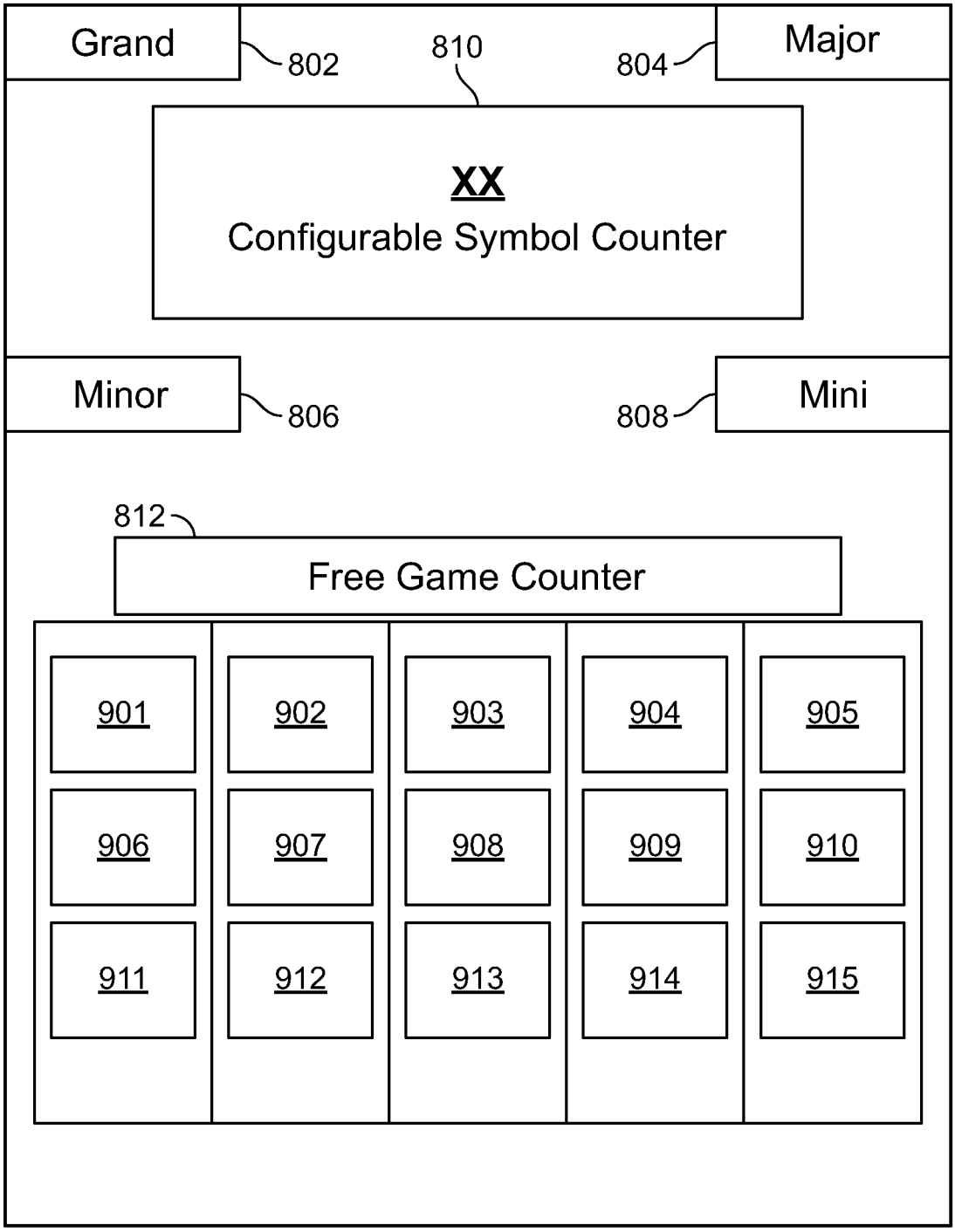
FIG. 9 is a schematic screen display layout for conduct of a series of free games.

At step 704, the processor 204 selects symbols for display at a set of display positions. In this example, an array of five columns and three rows of symbol positions 901-915 as best seen in FIG. 9. FIG. 3 illustrates an example of a set 300 of five reel strips 321, 322, 323, 324, 325 for use in the base game. In the example, each reel strip has fifteen reel strip positions 301-315. Each reel strip position 301-315 of each reel strip 321-325 has a symbol. Each of the reel strips, has a number of configurable symbols denoted as "Config" symbols in FIG. 3. For example, a "Config" symbol occupies the third reel strip position 303 of the first reel 321. Other reels strips to those illustrated in FIG. 3 can be used, for example, reel strips where two or more configurable symbols are placed at consecutive reel strip positions of a reel strip. In other examples, the reel strips could have more reel strip positions, for example, between 30 and 100 reel strip positions and different reel strips could have different numbers of reel strip positions. The actual length of the reel strips depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP). Similarly, the number of configurable symbols on a given reel strip affects the probability of a configurable symbol landing.

Figure 4:
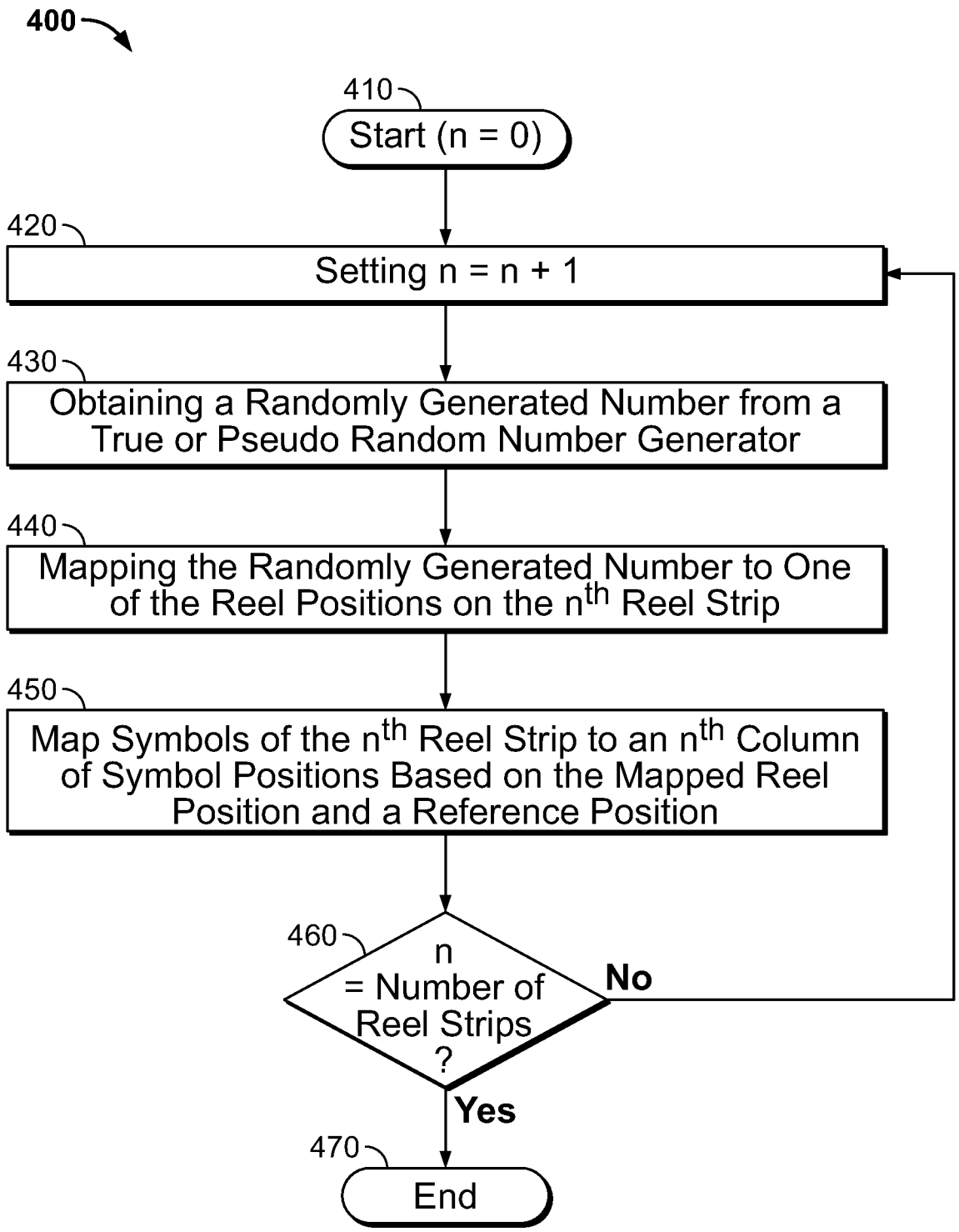
FIG. 4 is a flow chart of a symbol selection method.

FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430 the processor obtains a randomly generated number from a true or pseudo random number generator 212. At step 440 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of been selected. In other examples, the ranges may be arranged to weight the relative chances of selecting specific reel strip positions. As described above, where the ranges are each the same size so that each of the reel strip positions has the same chance of been selected for a specific reel strip, other reel strips may be of different lengths, thus affecting the probability of individual reel strip positions being selected.

At step 450, the processor 204 maps symbols of the nth reel strip to and nth column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In this example, there are two other symbol positions in the column of symbol positions and hence symbols at two neighboring reel strip positions are also mapped to the symbol positions of the column. Referring to the example reel strips of FIG. 3, if the value returned by the RNG 212 is mapped to reel position 313, then for the first reel strip 321, "Pic3" symbol 343 is mapped to a bottom symbol position, "10" symbol 342 is mapped to a middle symbol position, and "J" symbol is mapped to a top symbol position.

At step 460, the processor 204 determines whether symbols have been selected for all of the reel strips, and if not the processor reverts to step 420 and iterates through steps 430, 440 and 450 until it is determined at step 460 that symbols have been selected from all n reel strips and mapped to all n columns of symbol positions after which the symbol selection process ends 470. Different numbers of symbols may be mapped to different numbers of symbol positions.

After the symbols of all reel strips have been mapped to symbol position, the processor 204 controls display 240 to display them at the symbol positions.

In one embodiment, prior to display of any configurable symbols, at step 706, the processor 204 assigns a prize to each configurable symbol that will be displayed after the symbols have been selected for symbol positions but before they are displayed. In another example, the processor 204 assigns values to each of the configurable symbols of each of the reel strips each time a game is played.

In one example, the prizes are selected from a weighted table, such as Table 1 below. In one example, Weightings 1 to 4 and Weightings 5 to 8 are arranged to reflect the relative sizes of the prizes and in order to control the return to player. The processor 204 selects the prizes at random according to the weighted probability using random number generator.

TABLE 1

| Prize | Weighting |
|---|---|
| State-wide jackpot chance | Weighting 1 |
| Major jackpot | Weighting 2 |
| Minor Bonus | Weighting 3 |
| Mini Bonus | Weighting 4 |
| 100 × multiplier | Weighting 5 |
| 50 × multiplier | Weighting 6 |
| 20 × multiplier | Weighting 7 |
| 5 × multiplier | Weighting 8 |

As can be seen from Table 1 some of the values of prizes are generated by applying one of a predefined multipliers to an amount wagered in credits. In one embodiment, there are four denominations available for selection, 1 c, 2 c, 5 c and 10 c that can be selected by the player. The selected denomination is also used by the processor to control the amount contributed to Grand and Major jackpot prizes and the magnitude of Minor 806 and Mini 808 bonus awards. Those skilled in the art would appreciate that the denominations are not limited to four, but can include any suitable amount in any given currency. Note that while the selected denomination affects the magnitude of the Minor 806 and Mini 808 fixed bonus prizes offered, it does not affect the magnitude of the Grand 802 and Major 804 jackpots—only the contributions funding the amount. In embodiments of the invention, the Major jackpot prize is a progressive jackpot prize funded by contributions from the gaming device and the Grand jackpot prize is funded by a number of linked gaming devices.

That is, in this or other embodiments, at least one value of the respective prizes may comprise a predefined value and/or a jackpot. As used herein, the term "jackpot", as opposed to "prize", refers to a progressive prize which accumulates over multiple plays of the base game and/or the feature game. As will be appreciated, the jackpot may be funded from a variety of sources including from only the gaming device 200 itself, or from a plurality of gaming device 202—a so-called "link".

In another embodiment, the prizes may be randomly selected under the control of the processor from a set of available prizes. Specific prizes may be weighted so as to control the probability of certain prizes occurring. In some embodiments, there may be a plurality of sets of prizes and the processor 204 chooses the set of prizes from which values will be randomly selected on the basis of a player's wager in the base game.

Returning to FIG. 5, at step 710, the processor monitors play of the base game and determines whether a trigger event has occurred. In this embodiment, a trigger event occurs when six configurable symbols appear on in display positions 901-915. If a trigger event has not occurred, play of the base game continues and control reverts to step 702, once any awards are paid at step 708. However, if a trigger event does occur, the feature game initiates by the processor holding the configurable symbols at the display positions at which they have been selected, at step 711. In another embodiment, the triggering configurable symbols are moved to defined positions before the feature game occurs. In another embodiment, an alternative trigger is used and the feature game starts with no configurable symbols held in place.

In other embodiments, more than or less than six symbols will be required to trigger the feature game, or the feature game will be modified in a way that is proportional to the number of configurable symbols that are displayed to trigger the feature game. For example, the average or total prize achievable in the feature game may be increased in proportion to the number of configurable symbols appearing.

Figure 7:
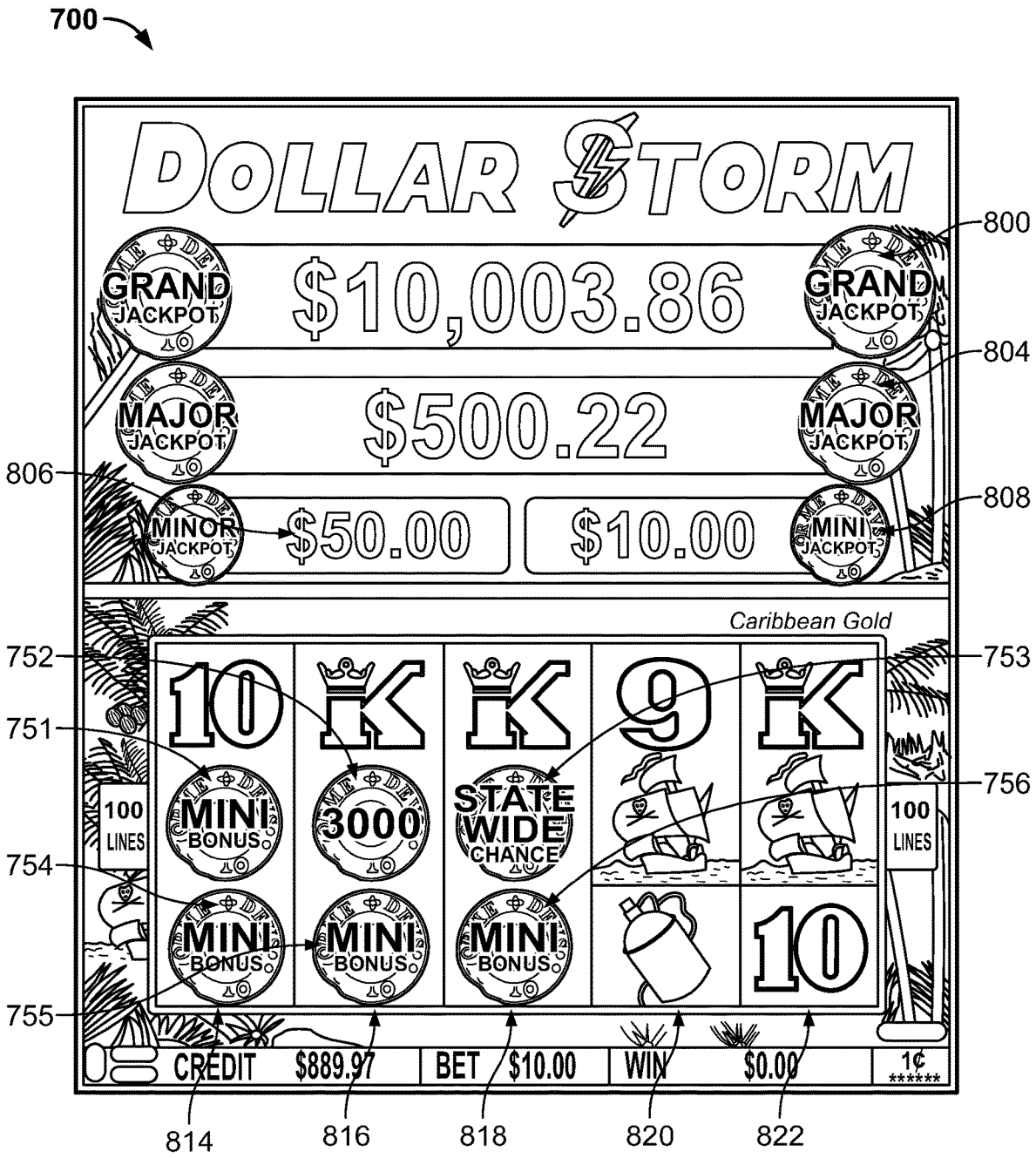
FIG. 7 is an example screen display.

FIG. 7 show an example screen display 700 where a trigger condition has occurred in a base game. Six configurable symbols 751-756 have been selected.

Figure 8:
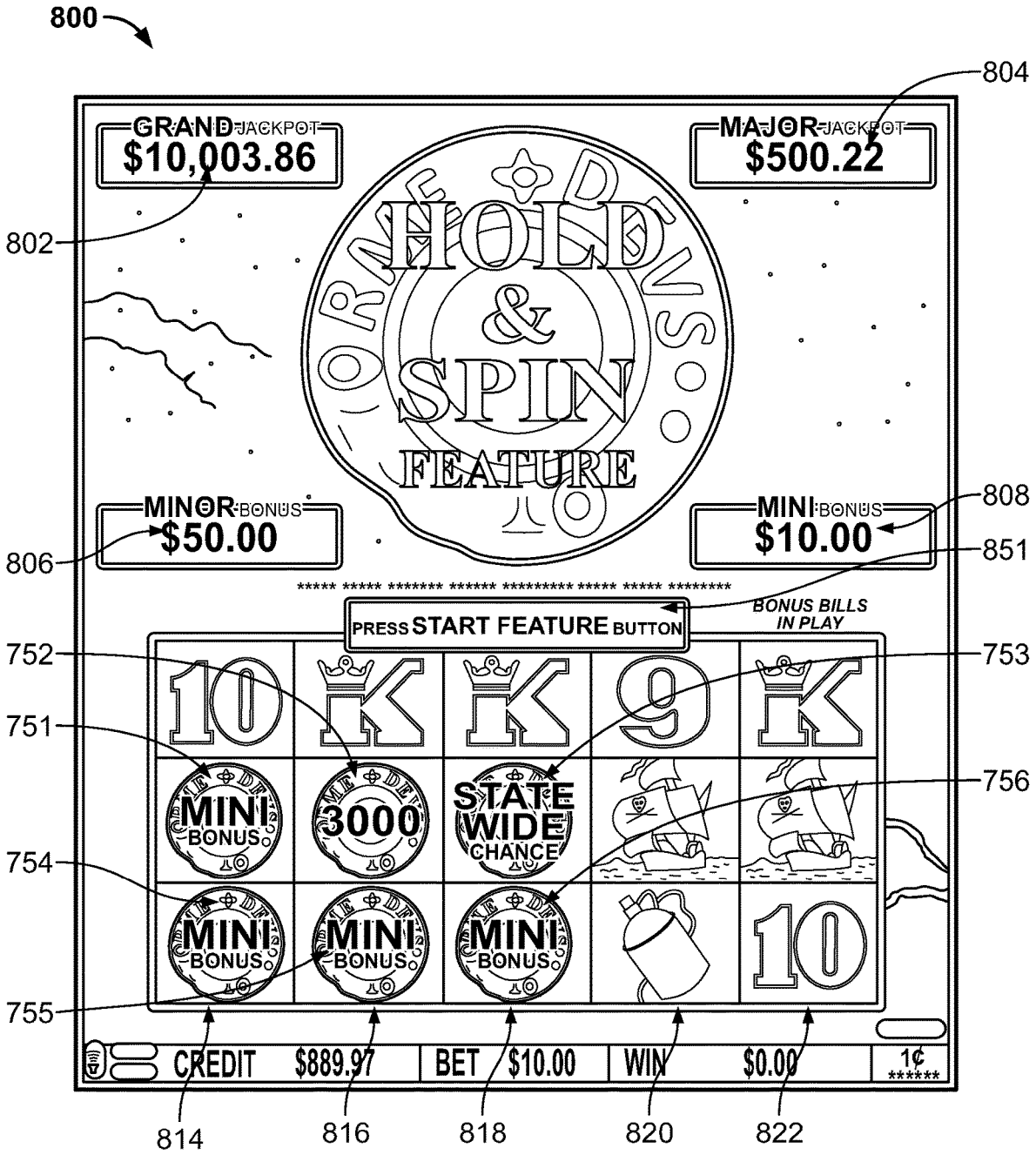
FIG. 8 is a further example screen display.

FIG. 8 shows a transitional screen display 800 where the configurable symbols are held and the remaining symbol positions are grayed out to indicate that further selections will be carried out in relation to these symbol positions by the processor 204.

At step 712, the processor 204 sets a configurable symbol counter in memory 208 to the number of configurable symbols that are held in columns 814-822 of symbol positions. A displayed configurable symbol counter 810 is added to display as shown in the schematic screen shot shown in FIG. 9. In this embodiment, the counter is set to the number of configurable symbols which originally triggered the feature game. That is, in this embodiment, the configurable symbol counter 810 is initially set to 6, as six configurable symbols are required to trigger the feature game.

At step 714 the processor 204 sets a free game counter in memory 208 to a predefined number of free games and controls the display to display the value of the counter 812. In an embodiment, the defined number of free games is three, so counter 812 is set to 3. In other embodiments, the number of free games may be more than or less than three or may be derived by the game controller from the number of configurable symbols that appear. For example, an additional free game may be offered for each configurable symbol that appears in addition to a predefined minimum required to trigger the feature game.

At step 716, the processor 204 selects symbols for the first free game. In this embodiment, the processor 204 selects the symbols from a second set of reels different to those used in the base game. In an example, individual reels are associated with each of the symbol positions. That is, for the fifteen symbol positions, fifteen reels are used. Each of the reels of the second set of reels comprises a mixture of non-configurable symbols and configurable symbols. That is, the reels are like the reels shown in FIG. 3, however they may be of different length and contain different numbers of configurable symbols. In this example, a one to one correspondence between reels and symbol positions is defined in memory and the processor 204 only selects symbols from reels corresponding to a display position at which a configurable symbol is not selected.

In another embodiment, reel strips of the second reel strip are dynamically associated with symbol positions before each free game. For example, the processor 204 use random number generator 212 to randomly select from the set of reel strips without replacement until a dynamic association is formed with each symbol positions. In embodiments, where the configurable symbols are held from the base game, this enables fewer reel strips to be used than there are symbol positions. In the example embodiment, nine reel strips can be used because there are fifteen symbol positions and six trigger symbols. Thus, in one implementation, the processor 204 first selects a reel strip from a set of reel strips for symbol position 901, removes the selected reel strip from the set, then repeats for symbol positions, 902-905, 909, 910 and 914 with the reel strip for symbol position 915 being the left-over reel strip after the other reel strips have been associated with symbol positions. A further advantage of this embodiment reel strips can be employed which have lower or higher probabilities of configurable symbols being selected, without these reel strips becoming associated with specific symbol positions. For example, one reel may be long (e.g. 100 symbols) and only contain only one configurable symbol in order to control the odds of the Grand Jackpot being awarded.

At step 716, the processor 204 plays the feature game by selecting symbols from the second reel strips. In the first free game, the processor 204 determines stopping positions for all of the reel strips. If any of the reels are stopped with a configurable symbol in place, that configurable symbol is held in position by holding/locking the reel (i.e. not spinning the reels in a subsequent free game). That is, in subsequent free games, reels are only re-spun at symbol positions where a configurable symbol has not been displayed. In embodiments where reel strips are dynamically associated with symbol positions, the processor 204 inhibits the reel strip from being selected in further free games. As in the base game, each configurable symbol is assigned a prize by the processor at least before it is displayed.

In each free game, the processor 204 determines whether a configurable symbol is selected and displayed at step 718. If a configurable symbol is not displayed, free game counter 812 is decremented at step 720.

At step 722, if there is at least one free game remaining as determined control returns to step 716 to continue the feature game. On the other hand, once the number of free games is depleted, that is, when the free game counter 812 reaches zero, the feature game ends and the processor proceed to step 728 to pay the feature award as will be described in more detail below.

Returning to step 718, if the processor determines that at least one configurable symbol is displayed in the columns of symbol positions 814-822, then that configurable symbol is held on the reel and the configurable symbol counter 810 is incremented at step 724. At step 726, the processor checks whether a predefined number of configurable symbols has been displayed on reels 814-822 at step 726 and, if the predefined number has been reached, proceeds to step 728.

The predefined number of configurable symbols in this embodiment is fifteen. That is, for this embodiment in which a game is implemented using a 5×3 matrix of symbol positions 901-915, configurable symbols must be selected and displayed in all the symbol positions 901-915. In other embodiments, the predefined number may be more than or less than fifteen. For example, in a 3-4-3-4-3 configuration of symbol positions, the number of configurable symbols required to fill all matrix positions would be 17. In yet other embodiments, not all of the matrix positions need be filled While in the above embodiments, the feature game ends when the Grand jackpot 802 is triggered at step 726 upon determination that the predefined number has been reached, in other embodiments, the feature game does not necessarily end at this point. In such embodiments, one or more of reels 814-822 are configured to expand and display additional symbol positions when counter 810 reaches the predefined number and the player still has free games. For example, a game implemented using a 5×3 matrix may expand to a 3-4-3-4-3 configuration.

Alternatively, if processor 204 determines that the predefined number of configurable symbols has not been reached at step 726, the feature game continues. In the embodiment of FIG. 5, each time a configurable symbol is selected and the jackpot is not won, free game counter 812 is reset by the processor 204 to the initial number of free games at step 714. Therefore, the number of free games actually carried out can vary from game to game and each spin includes the possibility that game play can be extended. As a result each free spin of the game is exciting for the player as not only can it contribute to the prize that is won but it can extend game play.

Figure 10:
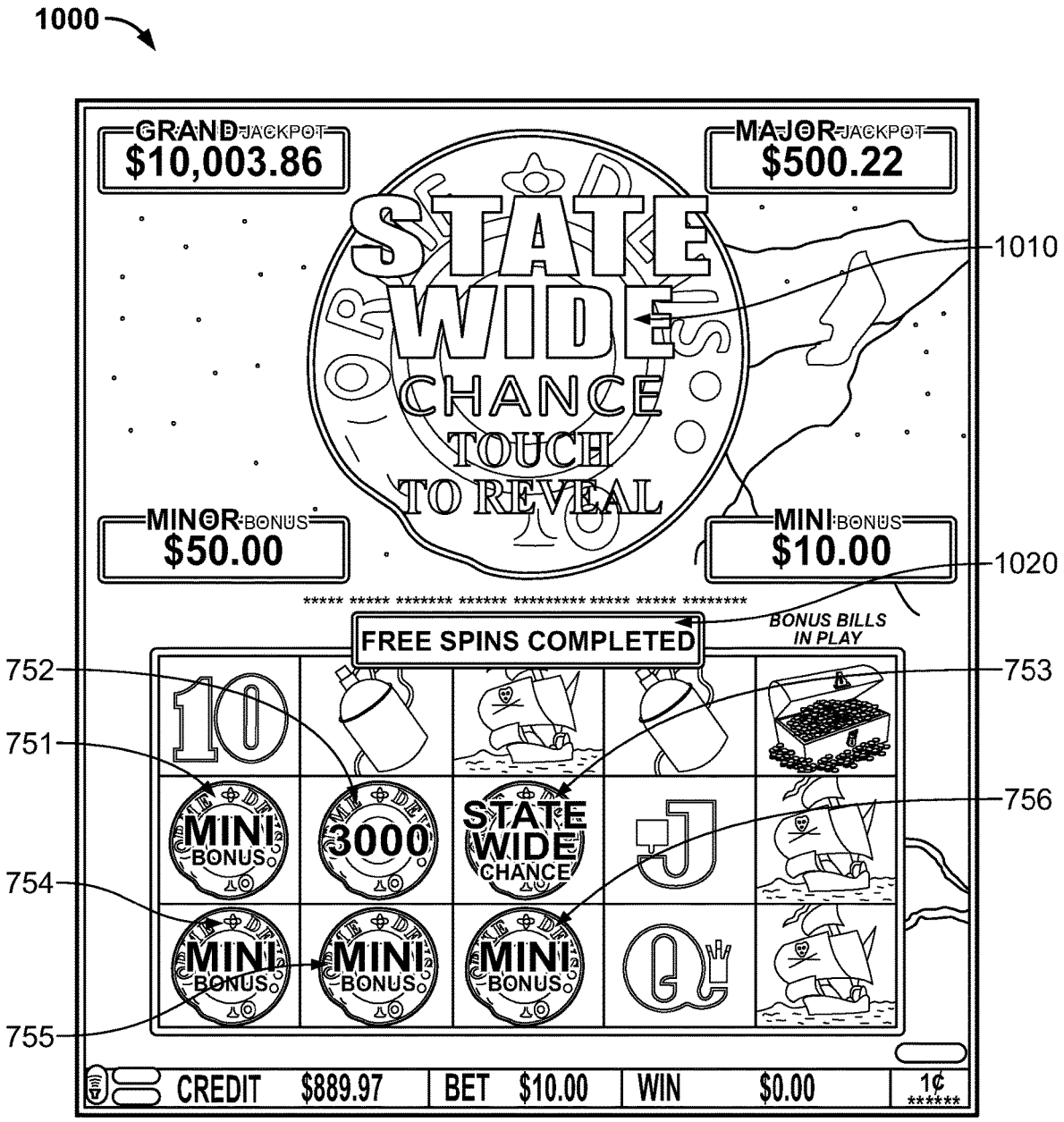
FIG. 10 is a further example screen display.

Once all free games have been exhausted the processor 204 pays the feature award at step 728. FIG. 10 shows an example screen shot 1000 at this stage of the game. In this example, configurable symbol 753 includes the "state wide chance" prize and hence, the message "state wide chance, touch to reveal" 1010 is displayed as well as the message "free spins completed" 1020.

Figure 6:
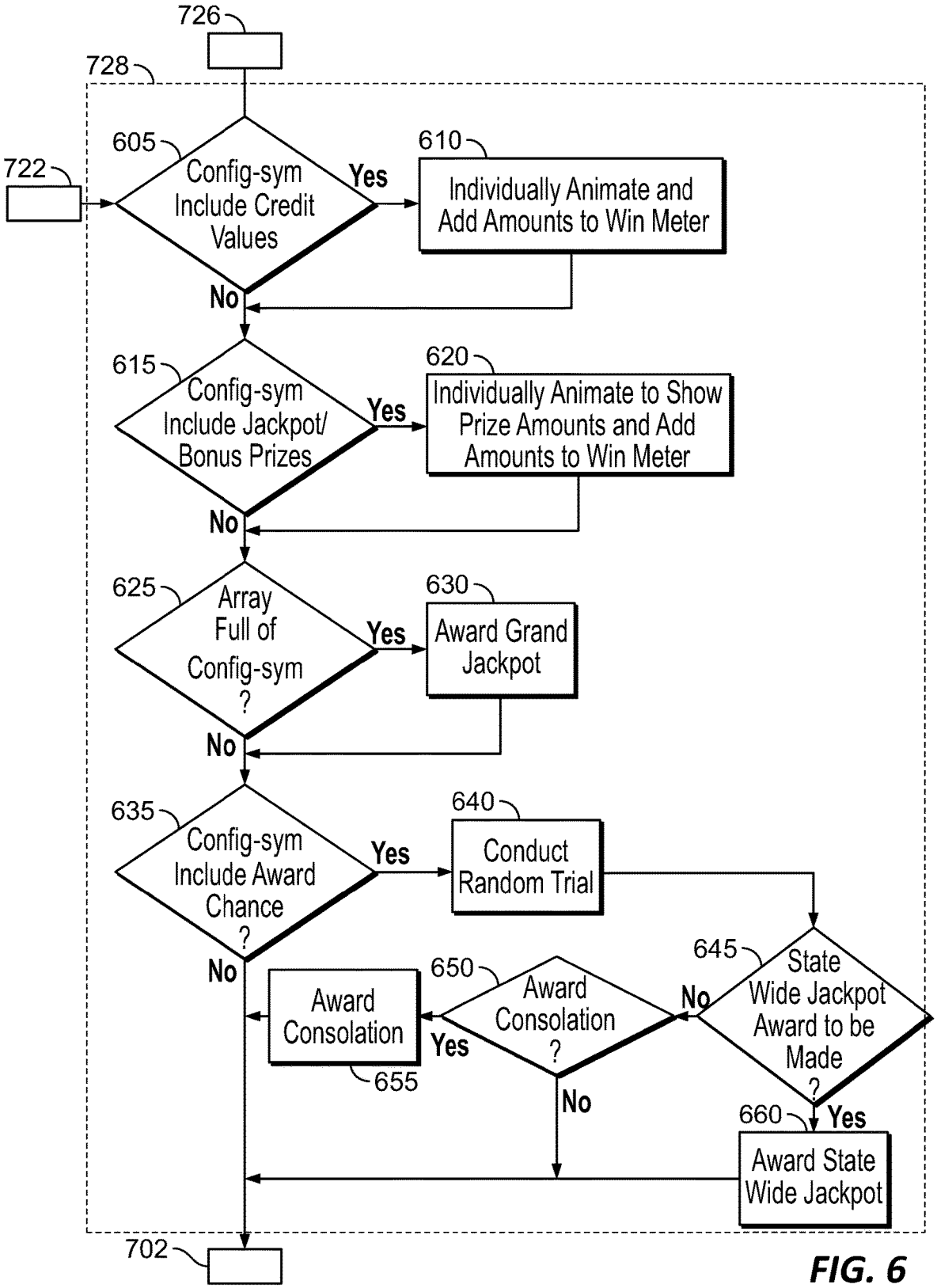
FIG. 6 is a flow chart showing detail of a feature pay step of the flow chart of FIG. 5.

In one example embodiment, the player can touch the select the state wide chance configurable symbol 753 at any time. In another example, the feature is paid as shown in FIG. 6 in order to build suspense towards evaluation of the state-wide jackpot chance which, in this embodiment, will typically be larger than all other prizes. Where the prize for the award chance is different, a different evaluation order may be appropriate.

At step 605, the processor 204 determines whether there are any credit values on the configurable symbols and if there are, the processor 204 individually animates each of the configurable symbols having credit values before adding the amounts to the win meter in memory 208 (for larger prizes, the processor 204 may add the win amounts directly to a credit meter in memory 208). In the example, shown in FIG. 10, the processor 204 animates configurable symbol 752 at this step and adds 3000 credits to the win meter.

At step 615, the processor 204 determines whether there are any bonus or jackpot prizes awarded from the gaming device. In this example, major prize 804 is implemented as a standalone progressive (SAP) jackpot which only takes contributions from the gaming device itself, incrementing the jackpot as a function of turnover. Minor 806 and Mini 808 prizes are implemented as fixed bonus amounts in proportion to the initial bet wagered. Accordingly, if any of these prizes appear on configurable symbols they are awarded at step 620. Again, referring to FIG. 10, the mini bonus prizes on configurable symbols, 751, 754-756 are animated and awarded at this step and the mini bonus ($10.00) is added to the win meter.

As indicated above, if it is determined by the processor 204 at step 625 that counter 810 has reached the predefined threshold, Grand prize jackpot 802 is paid at step 630. As indicated above, the grand prize in this embodiment is a linked jackpot which receives contributions from a plurality of linked gaming devices and is incremented based on the turnover of the linked gaming devices. Referring to the example of FIG. 10, at step 625, the processor 204 determines that no grand jackpot prize is to be awarded and proceeds to step 635.

Figure 11:
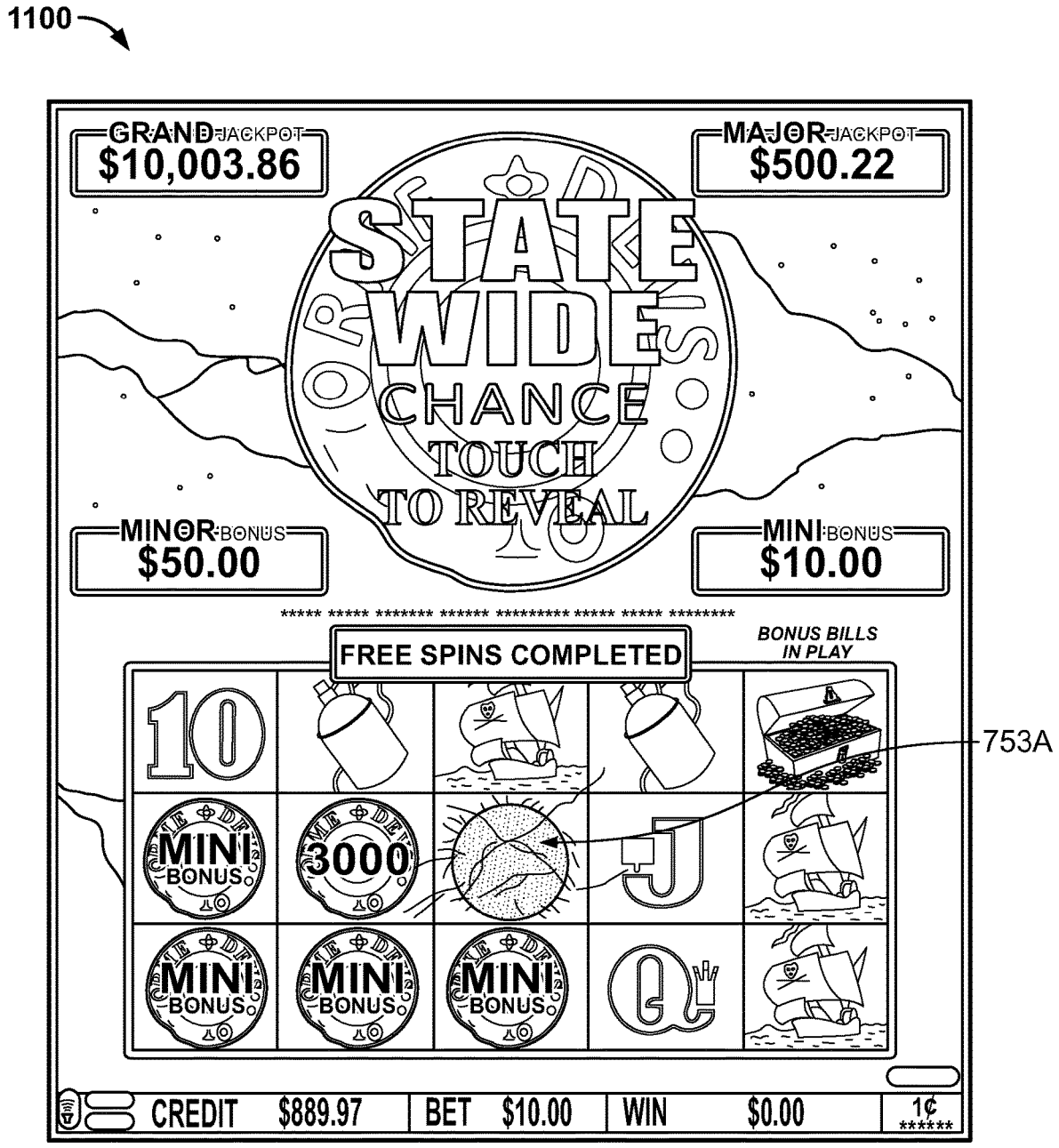
FIG. 11 is a further example screen display.

At step 635, processor 204 determines whether the configurable symbols including an award chance. In the example, of FIG. 10, the configurable symbol 753 has the prize indicia "State Wide Chance" on it, such that in this example, the process proceeds to step 640 after the player responds to the prompt 1010 and touches configurable symbol 753. FIG. 11 shows an example screen display 1100 after the player touches the configurable symbol. The display of the configurable symbol is changed to an animated lightning storm state 753A to indicate that the determination is being carried out.

At step 640, the processor 204 uses random number generator 212 to conduct a random trial. Table 2 gives an example of a weighted table to illustrate the process.

TABLE 2

| If random number is within: | Then prize awarded is: | Probability |
|---|---|---|
| 1-5 | State-wide jackpot | 0.05% |
| 6-100 | $2000 | 0.95% |
| 101-1000 | $500 | 9% |
| 1001-10000 | $0 | 90% |

In an embodiment, the processor 204 adjusts the weighted table based on the player's wager and selected denomination to ensure the chances of winning are linear across all wagers and denominations.

Figure 13:
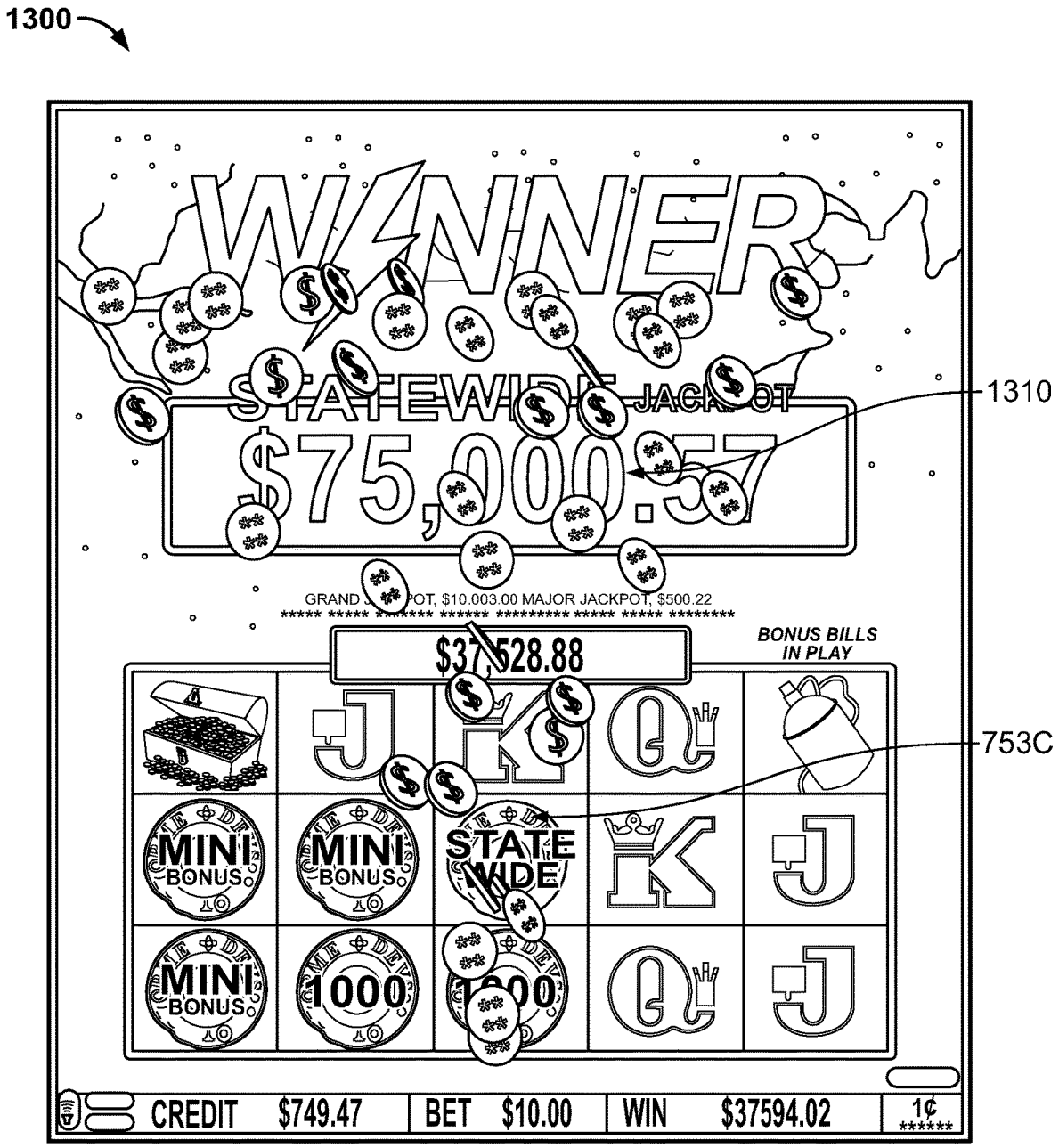
FIG. 13 is a further example screen display.

At step 645, the processor determines whether the state-wide jackpot is to be awarded and if it is, awards the state-wide jackpot at step 660. The processor controls the display 240 to display an award screen display 1300 as that shown in FIG. 13. In FIG. 13, the Statewide jackpot amount is displayed 1310 and the configurable symbol has its indicia changed to show "State Wide". In an example, the award is made by adding the award to the credit meter in memory 208. In other examples, there may need to be another payment mechanism, such as a venue representative obtaining details of the player to enable payment of the amount won.

Figure 12:
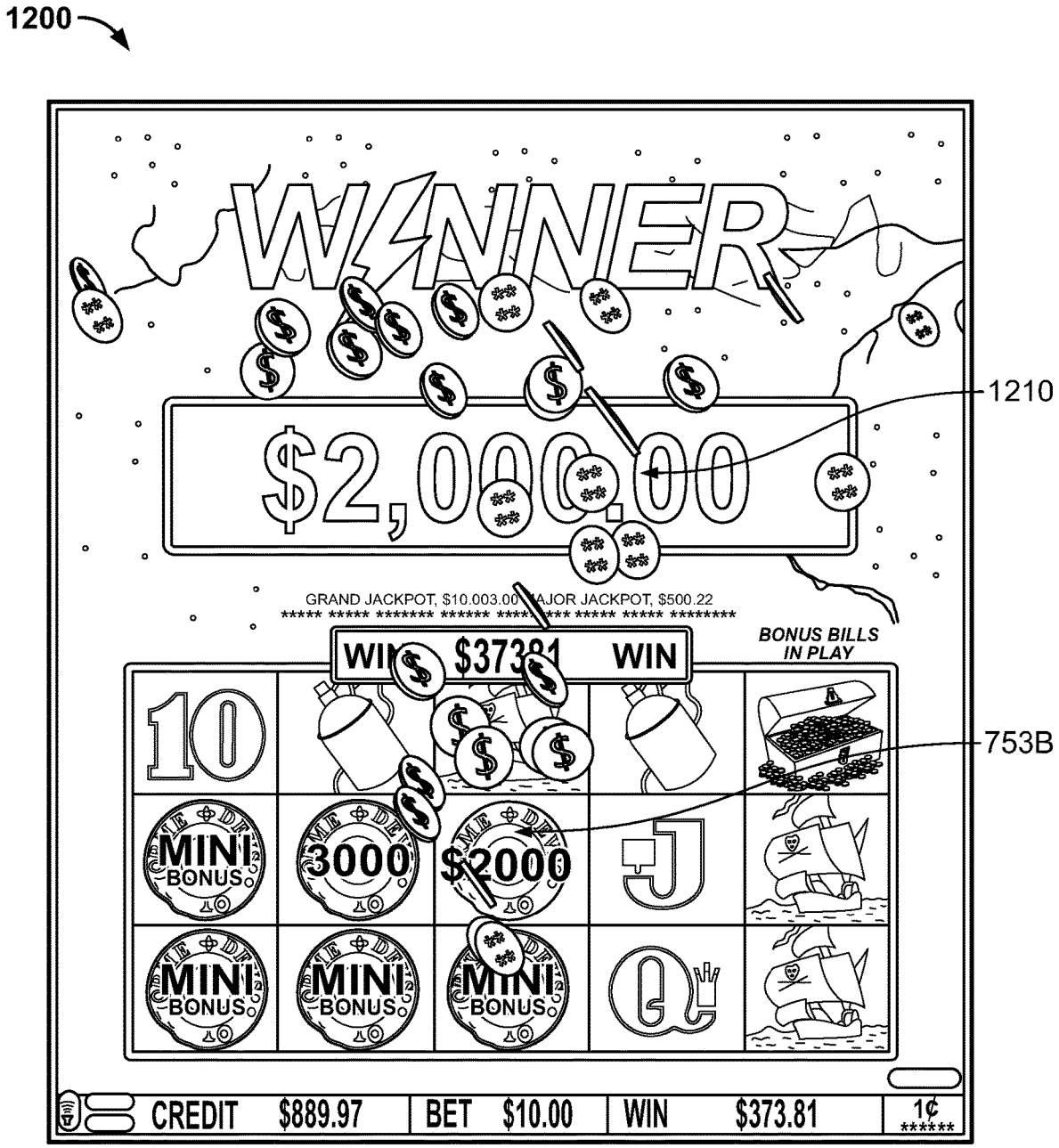
FIG. 12 is a further example screen display.

In some embodiments, such as that illustrated in Table 2, a player may win a consolation prize if they are unsuccessful with the state-wide jackpot. Accordingly, at step 650, the processor 204 determines whether the player is to be awarded either of the consolation prizes set out in Table 2 and, if so, the processor 204 makes the award at step 655. The processor also controls display 240 to display a consolation prize screen display 1200 including the prize amount 1210 and a modified configurable symbol where an indicia 753B corresponding to the awarded consolation prize of $2000 is added. See, e.g., FIG. 12.

Embodiments of the invention are advantageous in that they allow an award chance, such as for a prize to be awarded across multiple venues (here a "state-wide jackpot") to be integrated into a gaming device that provides a game having configurable symbols that carry prize amounts without interfering with the underlying game mechanic of collecting symbols to win a grand jackpot prize. Such an embodiment can add significantly to the excitement of playing the gaming device. Awarding a prize chance in this way also provides a lot of flexibility as to what awards can be won as the odds of winning a particular prize can be adjusted appropriately.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A gaming device, comprising:

a display device;

a memory device; and a processor executing instructions stored on the memory device, wherein execution of the instructions causes the processor to:

control the display device to present a game outcome received from a gaming server via a plurality of reels, wherein the game outcome randomly includes zero or more instances of a configurable symbol, wherein each instance of the configurable symbol in the game outcome presents a prize value indicia from a plurality of prize value indicias or a prize chance indicia, wherein each prize value indicia of the plurality of prize value indicias identifies a specific prize value and has an associated probability of inclusion in the game outcome, and wherein the prize chance indicia identifies a chance to win a chance prize and has an associated probability of inclusion in the game outcome;

control the display device to display a presentation of an award for the game outcome, wherein the presentation of the award includes, for an instance of the configurable symbol in the game outcome whose respectively assigned prize indicia is the prize chance indicia:

an award of the chance prize if the instance of the configurable symbol randomly triggers, per a chance prize win probability associated with the prize chance indicia, a win of the chance prize; and no award if the instance of the configurable symbol randomly triggers, per a no prize probability associated with the prize chance indicia, a no prize result.

2. The gaming device of claim 1, wherein the presentation of the award includes, for each instance of the configurable symbol in the game outcome whose respectively assigned prize indicia is one of the prize value indicias, the specific prize value identified by the prize value indicia of its respectively assigned prize indicia.

3. The gaming device of claim 1, wherein the instructions cause the processor to control the display device to reveal for the instance of the configurable symbol assigned the prize chance indicia the chance prize in response to triggering the chance prize per a reveal probability assigned the chance prize.

4. The gaming device of claim 1, wherein the instructions cause the processor to control the display device to reveal for the instance of the configurable symbol assigned the prize chance indicia a multiple venue jackpot prize for the chance prize in response to triggering the multiple venue jackpot prize per a reveal probability assigned the multiple venue prize.

5. The gaming device of claim 1, wherein the instructions cause the processor to control the display device, in response to a user input associated with touching the instance of the configurable symbol in the game outcome to which the chance prize indicia is assigned, to reveal indicia on the touched instance of the configurable symbol that indicates whether the touched instance of the configurable symbol randomly triggered a win of a specific jackpot prize.

6. The gaming device of claim 1, wherein the instructions cause the processor to control the display device, in response to a user input associated with touching the instance of the configurable symbol in the game outcome to which the chance prize indicia is assigned, to reveal indicia on the touched instance of the configurable symbol that indicates whether the touched instance of the configurable symbol randomly triggered a win of a consolation prize instead of a specific jackpot prize.

7. The gaming device of claim 1, wherein the instructions cause the processor to control the display device to reveal that the instance of the configurable symbol with the chance prize indicia in the game outcome randomly triggered the award of a specific jackpot prize by, at least, replacing the chance prize indicia of the instance of the configurable symbol with indicia that indicates that the specific jackpot prize was awarded.

8. The gaming device of claim 1, wherein:

the prize indicia set comprises:

one or more fixed jackpot indicias, each associated with a respective fixed jackpot; and one or more progressive jackpot indicias each associated with a respective progressive jackpot; and the instructions cause the processor to control the display device to present:

for each instance of the configurable symbol with an assigned prize indicia from the one or more fixed jackpot indicias, an award of the fixed jackpot identified by the respectively assigned prized indicia; and for each instance of the configurable symbol with an assigned prize indicia from the one or more progressive jackpot indicias, an award of the progressive jackpot identified by the respectively assigned prize indicia.

9. The gaming device of claim 1, wherein the instructions cause the processor, for each remaining round of a quantity of rounds, to control the display device to replace each respective symbol of the game outcome that is not a configurable symbol with a replacement symbol.

10. The gaming device of claim 9, wherein the instructions cause the processor to at least:

decrement the quantity of rounds by a decrement quantity upon completion of a round of the quantity of rounds; and increment the quantity of rounds upon a condition of another round of the quantity of rounds.

11. A method of a gaming server, the method comprising:

providing a base game outcome to a gaming device for presentation by the gaming device, wherein the base game outcome comprises a plurality of symbols, and wherein the plurality of symbols of the base game outcome randomly includes zero or more instances of a configurable symbol;

in response to the base game outcome comprising a predetermined number of instances of the configurable symbol, providing a feature game outcome to the gaming device for presentation by the gaming device, wherein the feature game outcome comprises each instance of the configurable symbol from the base game outcome and a replacement symbol for each non-configurable symbol of the base game outcome, wherein each replacement symbol that is an instance of the configurable symbol includes either a prize chance indicia or another prize indicia selected from a plurality of other prize indicias, wherein the prize chance indicia identifies a chance to win a chance prize and has an associated probability of inclusion in the feature game outcome, and wherein each of the other prize indicias identify a prize and has an associated probability of inclusion in the feature game outcome; and causing the gaming device to present an award for the feature game outcome, wherein presentation of the award for the feature game outcome includes presentation of the chance prize for each instance of the configurable symbol in the feature game outcome with the prize chance indicia which randomly triggers an award of the chance prize per a chance prize win probability assigned to the prize chance indicia.

12. The method of claim 11, wherein the presentation of the award for the feature game outcome includes presentation of prizes identified by the other prize indicias assigned to the instances of the configurable symbol in the feature game outcome.

13. The method of claim 11, wherein the presentation of the award for the feature game outcome comprises presentation of a multiple venue jackpot prize in response to randomly triggering the award of the chance prize.

14. The method of claim 11, wherein the presentation of the award for the feature game outcome comprises presentation of a consolation prize in response to randomly triggering an award of the consolation prize per a consolation prize win probability assigned to the prize chance indicia.

15. The method of claim 11, wherein the presentation of the award for the feature game outcome comprises:

presentation of a first consolation prize in response to randomly triggering an award of the first consolation prize per a first consolation prize win probability assigned to the prize chance indicia; and presentation of a second consolation prize in response to randomly triggering an award of the second consolation prize per a second consolation prize win probability assigned the prize chance indicia.

16. The method of claim 11, wherein the presentation of the award for the feature game outcome comprises revealing whether the instance with the prize chance indicia randomly triggered the award the chance prize in response to player input that selects the instance of the configurable symbol with the chance prize indicia.

17. A non-transitory computer readable storage medium comprising instructions that, in response to being executed, cause a gaming server to:

provide a base game outcome to a gaming device for presentation by the gaming device, wherein the base game outcome comprises a plurality of symbols, and wherein the plurality of symbols of the base game outcome randomly includes zero or more instances of a configurable symbol;

provide, in response to the base game outcome comprising a predetermined number of instances of the configurable symbol, a feature game outcome to the gaming device for presentation by the gaming device, wherein the feature game outcome comprises each instance of the configurable symbol from the base game outcome and a replacement symbol for each non-configurable symbol of the base game outcome, wherein each replacement symbol that is an instance of the configurable symbol includes either a chance indicia or another indicia selected from a plurality of other indicias, wherein the chance indicia identifies a chance to receive a specific result associated with the chance indicia and has an associated probability of inclusion in the feature game outcome, and wherein each of the other indicias identify an associated result and has an associated probability of inclusion in the feature game outcome; and cause the gaming device to display a presentation of a feature game result for the feature game outcome, wherein the presentation of the feature game result includes a presentation of the specific result associated with the chance indicia for each instance of the configurable symbol in the feature game outcome with the chance indicia which randomly triggers the specific result per a first probability assigned to the chance indicia.

18. The non-transitory computer readable storage medium of claim 17, wherein execution of the instructions causes the gaming server to cause the gaming device to present, as part of the feature game result, results associated with the other indicias assigned to the instances of the configurable symbol in the feature game outcome.

19. The non-transitory computer readable storage medium of claim 17, wherein execution of the instructions causes the gaming server to cause the gaming device to present, as part of the feature game result, a multiple venue jackpot result in response to randomly triggering the specific result associated with the chance indicia.

20. The non-transitory computer readable storage medium of claim 17, wherein execution of the instructions causes the gaming server to cause the gaming device to present, as part of the feature game result, a consolation result in response to randomly triggering the consolation result per a second probability assigned to the chance indicia.

* * * * *